US007913489B2

(12) United States Patent
Angoshtari et al.

(10) Patent No.: US 7,913,489 B2
(45) Date of Patent: Mar. 29, 2011

(54) DEVICE FOR LOWERING TAIL PIPE EXHAUST TEMPERATURE

(75) Inventors: Negin Angoshtari, Northville, MI (US); Markus Schuster, Ann Arbor, MI (US); Adam J. Kotrba, Laingsburg, MI (US)

(73) Assignee: Tenneco Automotive Operating Company, Inc., Lake Forest, IL (US)

( * ) Notice: Subject to any disclaimer, the term of this patent is extended or adjusted under 35 U.S.C. 154(b) by 675 days.

(21) Appl. No.: 11/985,221

(22) Filed: Nov. 14, 2007

(65) Prior Publication Data

US 2008/0110164 A1 May 15, 2008

Related U.S. Application Data

(60) Provisional application No. 60/858,762, filed on Nov. 14, 2006.

(51) Int. Cl.
*F01N 1/00* (2006.01)

(52) U.S. Cl. ..... 60/324; 60/289; 60/317; 60/319; 60/320; 60/322; 181/228; 181/249; 181/283

(58) Field of Classification Search ..... 60/289, 60/293, 304, 317, 318, 319, 320, 322, 324; 181/212, 227, 228, 249, 251
See application file for complete search history.

(56) References Cited

U.S. PATENT DOCUMENTS

| | | | | |
|---|---|---|---|---|
| 2,586,788 A | | 2/1952 | Cushman | |
| 2,886,946 A | | 5/1959 | Parker | |
| 3,011,524 A | | 12/1961 | Seils, Jr. | |
| 3,022,934 A | * | 2/1962 | Gerald | 417/168 |
| 3,031,147 A | | 4/1962 | Goodrie | |
| 3,227,240 A | * | 1/1966 | Lee et al. | 181/217 |
| 3,244,255 A | | 4/1966 | Possell | |
| 3,285,709 A | | 11/1966 | Ennarino et al. | |
| 3,468,124 A | | 9/1969 | Hraboweckyj | |
| 3,726,091 A | | 4/1973 | Tontini | |
| 3,788,072 A | | 1/1974 | Burger | |
| 3,817,030 A | | 6/1974 | Renius et al. | |
| 3,857,458 A | | 12/1974 | Ohtani et al. | |
| 4,183,896 A | * | 1/1980 | Gordon | 422/168 |
| 4,196,585 A | | 4/1980 | Svischev et al. | |
| 4,198,817 A | | 4/1980 | Fujita et al. | |
| 4,638,632 A | | 1/1987 | Wulf et al. | |
| 5,378,435 A | * | 1/1995 | Gavoni | 422/177 |
| 5,962,822 A | * | 10/1999 | May | 181/264 |

(Continued)

FOREIGN PATENT DOCUMENTS

| | | |
|---|---|---|
| CH | 489702 | 4/1970 |
| FR | 531327 | 1/1922 |
| GB | 386901 | 1/1933 |
| GB | 584254 | 1/1947 |
| GB | 760493 | 10/1956 |

*Primary Examiner* — Binh Q. Tran
(74) *Attorney, Agent, or Firm* — Wood, Phillips, Katz, Clark & Mortimer

(57) ABSTRACT

A component for a vehicular exhaust pipe includes an upstream venturi forming portion for creating at least a partial vacuum interior to the component. A downstream diverter housing portion of the component has an inlet coupled to an outlet of the venturi portion. The diverter housing portion includes the diverter element positioned adjacent an output of the diverter housing portion for forcing axially central exhaust flow radially outward toward a wall of the diverter housing. The partial vacuum in the component device causes colder environmental ambient air to enter an inlet of the component. The diverter also creates a mixture of hot exhaust flow with the colder environmental air, resulting in a lower temperature of the exhaust gas exiting the component and substantial elimination of centrally disposed exhaust hot spots.

9 Claims, 2 Drawing Sheets

U.S. PATENT DOCUMENTS 7,487,633 B2 * 2/2009 Popik et al. ..... 60/289
7,506,722 B2 * 3/2009 Emler ..... 181/249
2004/0206573 A1 10/2004 Hsu
2007/0119985 A1 5/2007 Ranganathan et al.

* cited by examiner

DEVICE FOR LOWERING TAIL PIPE EXHAUST TEMPERATURE

CROSS-REFERENCE TO RELATED APPLICATIONS

This application claims the benefit of the filing date of U.S. Provisional Application No. 60/858,762, filed Nov. 14, 2006, which is hereby incorporated by reference.

FEDERALLY SPONSORED RESEARCH OR DEVELOPMENT

Not Applicable.

MICROFICHE/COPYRIGHT REFERENCE

Not Applicable.

FIELD OF THE INVENTION

The disclosure relates generally to vehicle exhaust treatment devices and more specifically to an exhaust pipe component or attachment for reducing exhaust temperature and eliminating hot spots in the exhaust flow exiting a vehicle.

BACKGROUND OF THE INVENTION

The statements in this section merely provide background information related to the present disclosure and may not constitute prior art.

Conventional tail pipe temperatures, especially for diesel particulate filter applications show peaks as high as 650° C. with so-called "hot spots" in the axial center of the flow exiting the tail pipe. Such exhaust gas temperatures can potentially ignite flammable materials, such as dry grass along a roadside. Hence, there is seen to be a need in the art for a component device for an exhaust pipe, such as a tail pipe of a vehicle, for lowering the exhaust temperatures while avoiding isolated hot spots in the center of the exhaust flow emanating from the vehicle.

SUMMARY OF THE INVENTION

An component for a vehicular exhaust pipe includes an upstream venturi forming portion for creating at least a partial vacuum interior to the component. A downstream diverter housing portion of the component has an inlet coupled to an outlet of the venturi portion. A gap or inlet is formed between the venturi forming portion and the diverter housing portion. The diverter housing portion includes a diverter element positioned adjacent an output of the diverter housing the diverter housing. The partial vacuum in the component device causes colder environmental ambient air to enter the diverter housing portion through the gap or inlet. The diverter also creates a mixture of the hot exhaust flow with the colder environmental air, resulting in a lower temperature of the exhaust gas exiting the component and substantial elimination of centrally disposed exhaust hot spots.

Other objects, features, and advantages of the invention will become apparent from a review of the entire specification, including the appended claims and drawings.

BRIEF DESCRIPTION OF THE DRAWINGS

The objects and features of the disclosure will become apparent from a reading of a detailed description, taken in conjunction with the drawing, in which.

DETAILED DESCRIPTION OF THE PREFERRED EMBODIMENT

Figure 1:
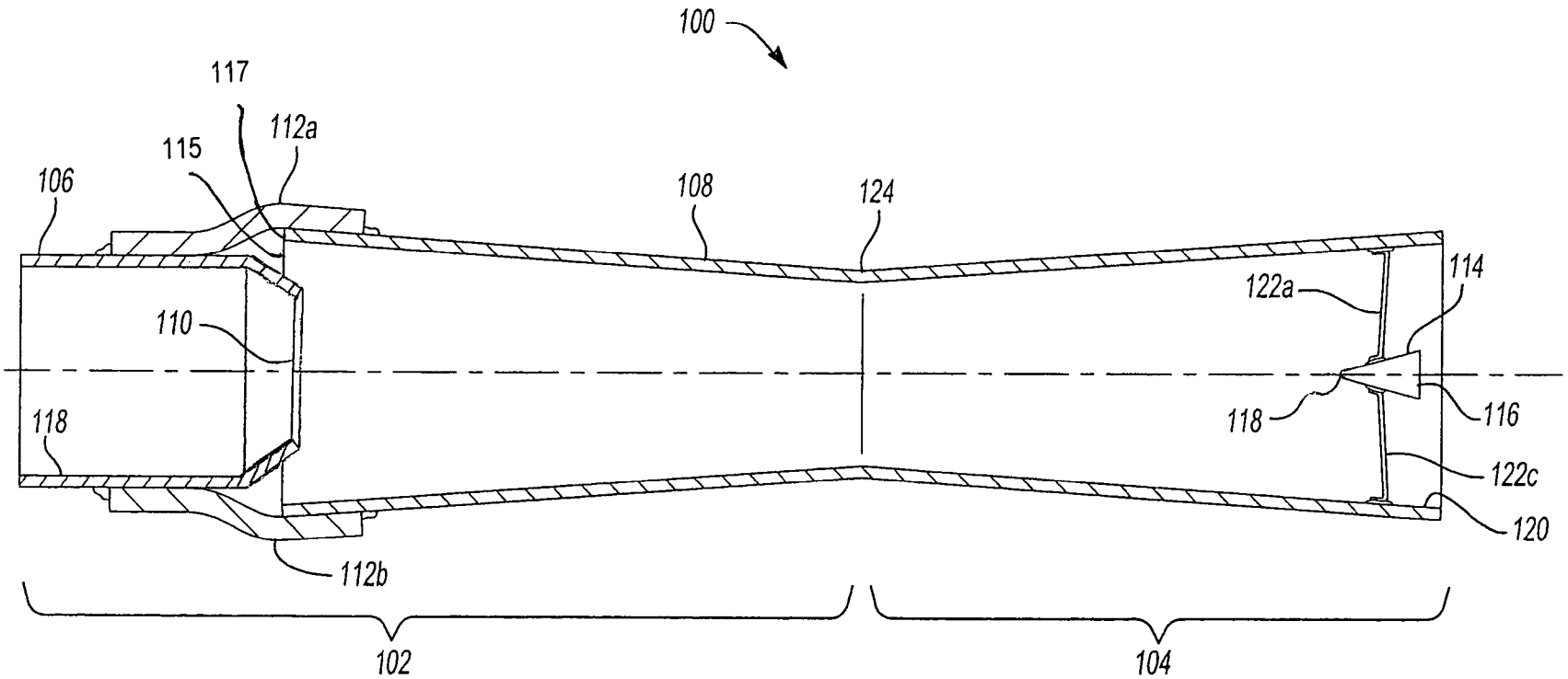
FIG. 1 is a side cross-sectional view of a combination venturi/diverter exhaust pipe component arranged in accordance with the principles of the invention.

The following description is merely exemplary in nature and is not intended to limit the present disclosure, applications, or uses. It should be understood that throughout the drawings, corresponding reference numerals indicate like or corresponding parts and features.

Figure 2:
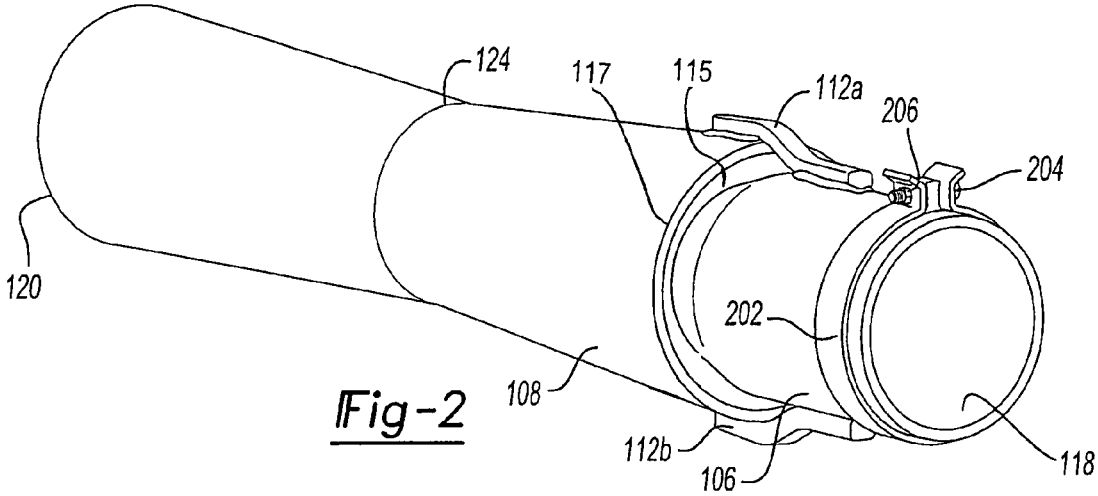
FIG. 2 is a side perspective view of the component of FIG. 1.
Figure 3:
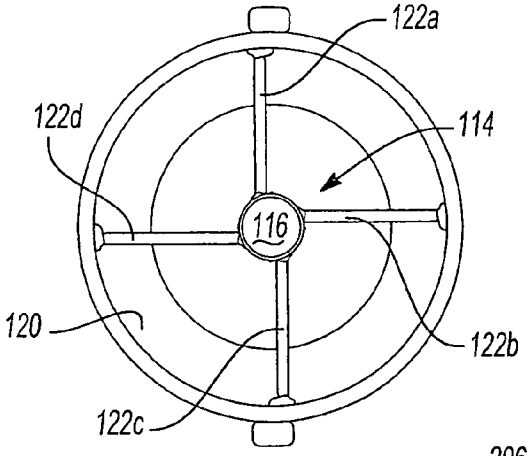
FIG. 3 is an end perspective view at the diverter end of the component of FIG. 1.
Figure 4:
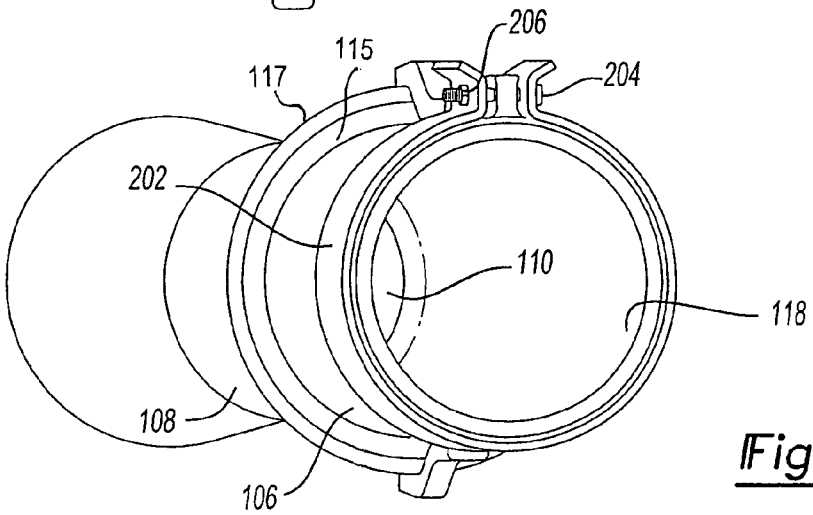
FIG. 4 is an end perspective view at the venturi forming member inlet end of the component of FIG. 1.

With reference to FIGS. 1-4, component 100 is intended preferably for coupling to a tail pipe of a vehicular exhaust system, and is comprised of an upstream portion 102 and a downstream portion 104.

Upstream portion 102 includes a venturi forming element or nozzle 106 and an upstream portion of the diverter housing 108 which tapers from an inlet end to point 124. Venturi forming element 106 is coupled to the upstream portion 102 of housing 108 by a plurality of legs 112, two being shown in FIG. 1 as 112*a* and 112*b*. Diverter housing portion 108 and venturi forming portion 106 are attached to opposite ends of legs 112 by, for example, welding.

Venturi forming element 106 narrows radially at 110 internally of diverter housing 108 to create a jet generating higher exhaust flow velocities, resulting in a suction effect, which, in turn, creates at least a partial vacuum inside component 100. The partial vacuum draws colder environmental ambient air into an annular inlet 115 formed between the outer wall of the element 106 and an inlet end 117 of the diverter housing portion 108.

Diverter 114, in a preferred form, comprises a conical element 114 having an apex 118 facing the oncoming exhaust stream and a base 116 facing the output 120 of component 100.

Diverter 114 is mounted centrally of the wall of substantially cylindrical diverter housing portion 108 by a plurality of mounting struts or legs 122 (four shown in the drawing—122*a, b, c* and *d*). Struts 122*a-d* are attached, for example, by welding, at first inner ends to diverter 114 and at second outer ends to an interior surface of the cylindrical wall of housing 108.

Nozzle 106 is adapted to be coupled at its input 118 to an end of an exhaust tail pipe (not shown), for example, by a radial clamp 202 whose ends accept a bolt 204 engaged by a nut 206.

In operation, hot exhaust gas enters input 118 of venturi forming element 106 from the vehicle's tail pipe to form a jet at restriction 110. The resultant partial vacuum in housing 108 pulls in cooler ambient air from outside the exhaust system into inlet 115 to mix with the hot exhaust gas moving toward diverter 114 and outlet 120. Diverter 114 forces the mixture radially outwardly toward the substantially cylindrical wall of housing 108, thereby eliminating hot spots along the central axis of the exhaust flow. The ambient air/exhaust mixture also results in a lower temperature exhaust stream exiting component 100. Additionally, the exhaust gases exiting the outlet 120 are mixed and further diluted outside of the device by pulling ambient air into a low pressure area (vena contracta) formed downstream of the diverter 114 and the outlet 120.

The invention has been described with reference to a preferred embodiment which has been set forth for the sake of example only. The scope and spirit of the invention will be derived from appropriate construction of the appended claims.

The invention claimed is:

1. A component for a vehicular exhaust pipe comprising: an upstream portion containing a venturi forming element operative to create at least a partial vacuum inside the component by generating exhaust flow velocities resulting in a suction effect at an inlet of the component; and a downstream portion having a diverter element positioned adjacent an outlet of the component, the diverter element operative to force axially central exhaust flow in the component radially outwardly, wherein the upstream portion has a frusto-conical surface that reduces to a necked-down portion that joins the downstream portion, the downstream portion having a frusto-conical surface that enlarges from the necked-down portion.

2. The component of claim 1 wherein the venturi forming element comprises a conduit having a first end opening at an input of the component for receipt of incoming exhaust flow and a second end, smaller in cross-sectional area than the first end facing an interior of the component.

3. A component for a vehicular exhaust pipe comprising: an upstream portion containing a venturi forming element operative to create at least a partial vacuum inside the component by generating exhaust flow velocities resulting in a suction effect at an inlet of the component; and a downstream portion having a diverter element positioned adjacent an outlet of the component, the diverter element operative to force axially central exhaust flow in the component radially outwardly, wherein the venturi forming element is coupled to the upstream portion by a plurality of mounting legs extending between the venturi conduit and the upstream portion.

4. The component of claim 1 wherein the diverter element comprises a conical structure having an apex facing the incoming exhaust flow and a base facing the outlet of the component.

5. The component of claim 1 wherein the diverter element is coupled to the downstream portion by a plurality of radially extending mounting legs.

6. The component of claim 1 wherein the downstream portion meets the upstream portion at a necked-down substantially axially central point of the component.

7. The component of claim 1 wherein the component is adapted to be coupled to an exit end of a tailpipe of the vehicle.

8. The component of claim 7 wherein the component is adapted to be coupled to the exit end by a radial clamp.

9. A component for a vehicular exhaust tailpipe comprising: a housing having an upstream portion and a downstream portion, each extending from an end of the component to a necked-down substantially axially central portion of the housing, wherein the upstream portion has a frusto-conical surface that reduces to a necked-down portion that joins the downstream portion, the downstream portion having a frusto-conical surface that enlarges from the necked-down portion; a venturi forming element mounted at an input of the upstream portion operative to create at least a partial vacuum inside the housing by generating exhaust flow velocities resulting in a suction effect at a housing inlet; and a conical diverter mounted to an interior of the housing adjacent a housing output, an apex of the conical diverter facing an interior of the housing, a base of the conical diverter facing the housing output to divert exhaust flow radially outward to mix with ambient air.

* * * * *